United States Patent [19]

Latino et al.

[11] Patent Number: 4,545,554

[45] Date of Patent: Oct. 8, 1985

[54] WRIST SUPPORT FOR USE WITH AN OFFICE MACHINE HAVING A KEYBOARD

[76] Inventors: Richard M. Latino, 473 Burncoat St., Worcester, Mass. 01606; David K. Crabbe, P.O. Box 122, Auburn, Mass. 01501

[21] Appl. No.: 298,134

[22] Filed: Aug. 31, 1981

[51] Int. Cl.[4] ..... B43L 15/00

[52] U.S. Cl. ..... 248/118.1; 248/118.3; 248/188.4

[58] Field of Search ..... 248/188.4, 188.1, 188.2, 248/118, 118.1, 118.3, 118.5; 108/43; 84/469, 328

[56] References Cited

U.S. PATENT DOCUMENTS

| | | | |
|---|---|---|---|
| 134,116 | 12/1872 | West | 248/118.1 |
| 1,632,383 | 6/1927 | Seiden et al. | 248/188.4 |
| 2,476,381 | 7/1949 | Peavey | 248/188.4 |
| 2,496,276 | 2/1950 | Dolas | 248/118 X |
| 3,027,680 | 4/1962 | Gallagher | 248/188.4 |
| 4,061,298 | 12/1977 | Kober | 248/188.4 |
| 4,228,745 | 10/1980 | Gale | 248/188.4 |

FOREIGN PATENT DOCUMENTS

| | | | |
|---|---|---|---|
| 207799 | 3/1909 | Fed. Rep. of Germany | 248/118.1 |
| 278238 | 9/1914 | Fed. Rep. of Germany | 84/469 |
| 285585 | 1/1953 | Switzerland | 248/188.4 |
| 433338 | 8/1935 | United Kingdom | 248/188.4 |

*Primary Examiner*—Ramon S. Britts
*Assistant Examiner*—Sarah A. Lechok

[57] ABSTRACT

This invention relates to office machines and accessories therefor, and more particularly to a wrist support for use with office machines having a keyboard such as a computer terminal keyboard. The wrist support described and claimed herein is a device which is designed to fit horizontally against the front of the keyboard thus providing means of support for the operators arms.

6 Claims, 9 Drawing Figures

WRIST SUPPORT FOR USE WITH AN OFFICE MACHINE HAVING A KEYBOARD

This invention relates to office machines and accessories therefor, and more particularly to a wrist support for use with office machines having a keyboard such as a computer terminal keyboard.

The operation of a computer terminal keyboard over extended periods of time involves a great number of muscular activities of hands, wrists, arms and shoulders. The fact that the entire extremity is suspended without support leads to greater physical strain than necessary. More effort goes into keeping the arms suspended than into the task of operating the keyboard. Fatigue and reduced productivity are the result.

The wrist support described and claimed herein is a device which is designed to fit horizontally against the front of the keyboard thus providing means of support for the operators arms. The contour of the Wrist Support is such that it provides the proper support angle and has no projections which could cause injury or discomfort. Its surface is smooth and hard thus reducing to a minimum the amount of drag on the forearms as they are slid back and forth. The unit is adjustable in height, providing the optimum relationship between the hands of the operator and the various function keys of the keyboard. This adjustment permits the operator to vary the height to suit his or her individual preferences or comfort. Of importance is the ease with which this is accomplished. The height may be readily adjusted by the keyboard operator without tools and without lengthy interruption of his or her work.

The wrist support, made in accordance with this invention, is provided with preferably two knobs which, when turned, raise or lower a support bar relative to a base. The device does not require attachment to the keyboard or the work surface though, if desired, this can be accomplished, for example, by bolting the base to either one. The design achieves optimal qualities in a device which can be economically manufactured.

Accordingly, an object of the present invention is to provide a wrist support for office machines having a keyboard.

Another object of the present invention is to provide a wrist support designed to reduce the physical strain of a keyboard operator.

A further object is to provide a wrist support which is adjustable in height.

A still further object of the invention is to provide a wrist support which can be economically manufactured.

Yet another object of the present invention is to provide a wrist support which can be adjusted by the keyboard operator without tools and without lengthy interruption of his or her work.

These and other objects are met in the present invention which is comprised of a base, a support bar disposed for vertical movement relative to said base, and at least one rotatable means connected to said base and threadedly engaging said support bar, wherein rotation of said means raises or lowers said support bar relative to said base.

BRIEF DESCRIPTION OF THE DRAWINGS

For a fuller understanding of the nature and objects of the present invention, reference should be had to the following detailed description taken in connection with the accompanying drawings in which like reference numerals designate like features, and wherein.

DETAILED DESCRIPTION OF THE PREFERRED EMBODIMENT

Figure 1:
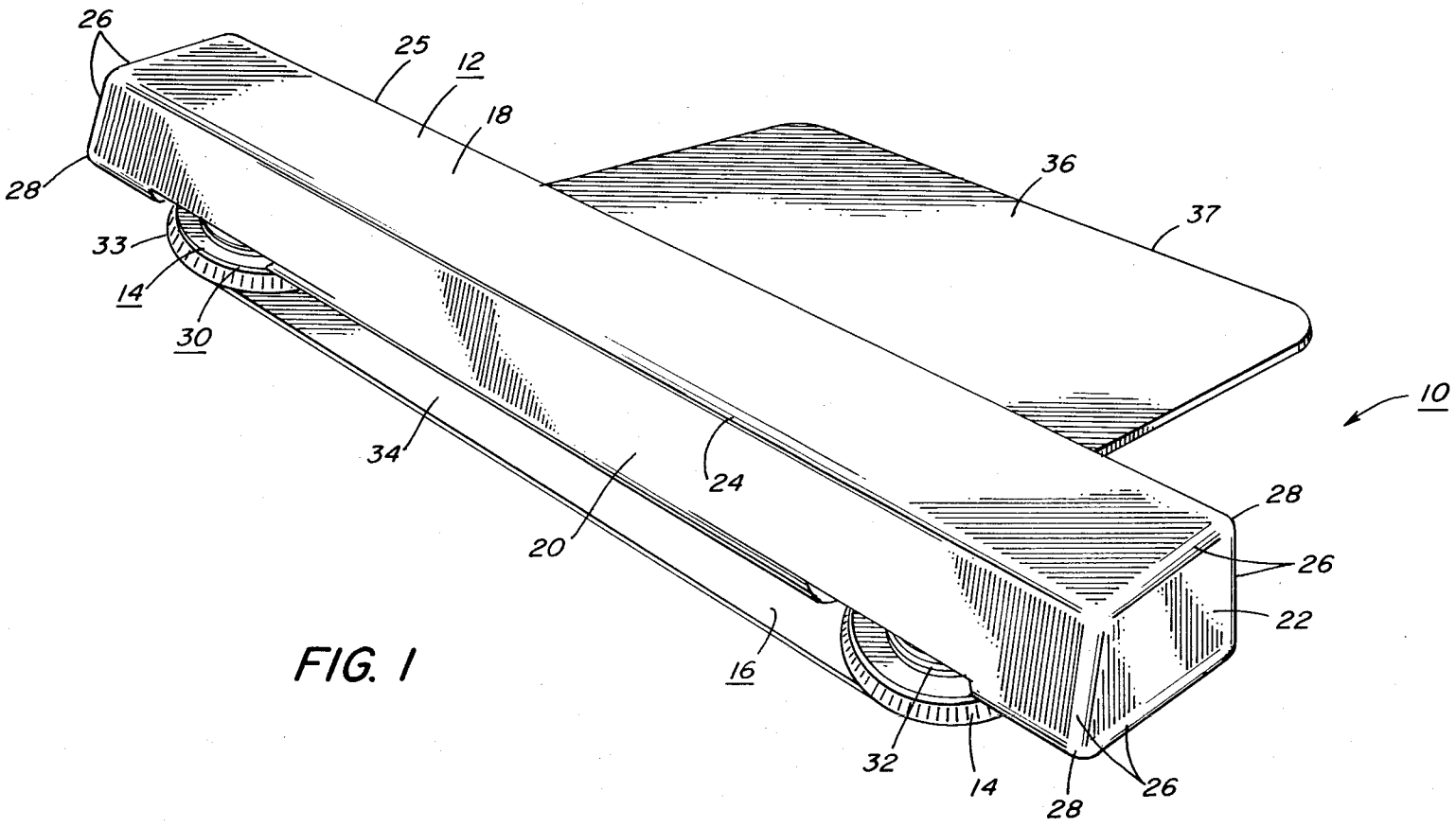
FIG. 1 is a perspective view of a wrist support made in accordance with the present invention.

Referring to FIGS. 1 through 5, a wrist support 10 made in accordance with the invention is illustrated in perspective views in which its features are shown as including a support bar 12 mounted on a plurality of rotatable means 14 for translational movement towards and away from a base 16. (The translational movement is in the vertical direction indicated by arrows 17 shown in FIG. 2.)

The support bar 12 may, for example, be molded of a plastic such as structural foam. Its external geometry is substantially that of an elongate box having generally rectangular top, bottom, front and rear surfaces, respectively designated 18, 19, 20 and 21. The top surface 18 is inclined at an angle, for example, of five degrees relative to and in spaced relation from the bottom surface 19, and extending from the front 20 to the rear surface 21. The width of the top surface 18 from side surface 22 to side surface 23 is chosen to accomodate either one or both hands of the operator, and may, for example, be 20–30 centimeters. The included side surfaces 22 and 23 are in spaced relation to one another and extend, for example, ten degrees from the perpendicular towards one another at their join to the top surface 18. The rear surface 21 extends in the vertical direction a greater distance than the front surface 20 due to the inclination of the top surface 18. Edges 24 and 25 between the top surface 18 and the front and rear surfaces 20 and 21, respectively, are each provided with a generous radius of approximately one centimeter. This radius, as well as the inclination of the top surface 18 is designed to provide comfort for the wrist of an operator. Preferably, edges 26 of the side surfaces 22 and 23 are provided with a sufficient radius, and corners 28 are sufficiently rounded to prevent injury.

Figure 2:
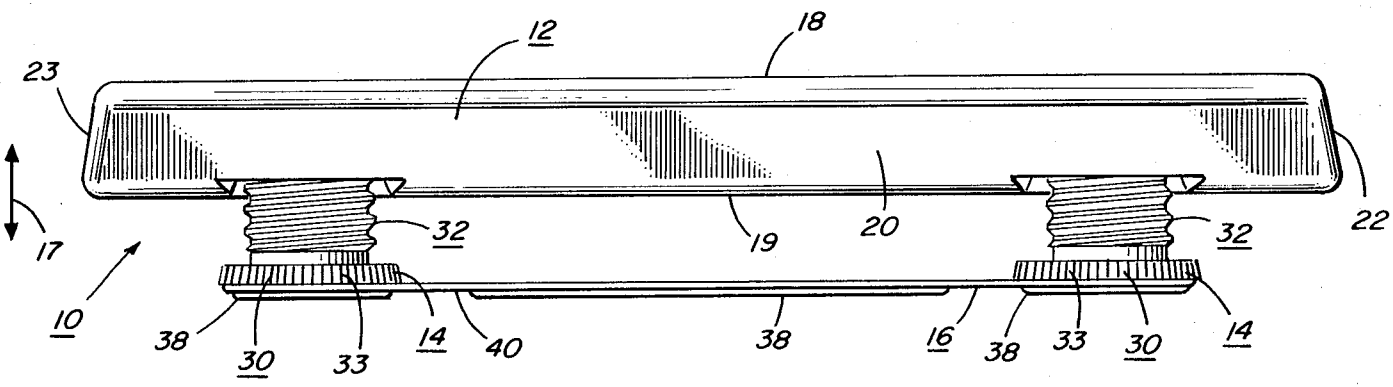
FIG. 2 is a front view in elevation of FIG. 1 as shown with the support bar in a higher position relative to the base.
Figure 3:
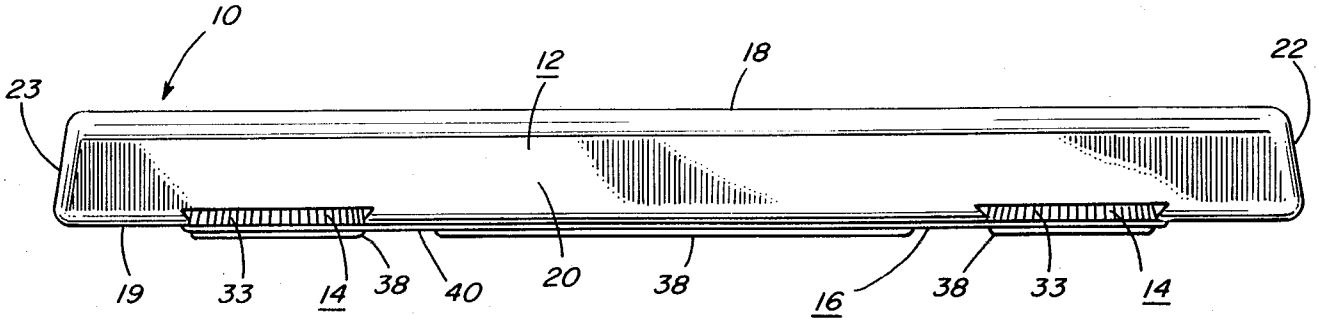
FIG. 3 is a front view in elevation of FIG. 1 except with the support bar shown in a lower position relative to the base.
Figure 5:
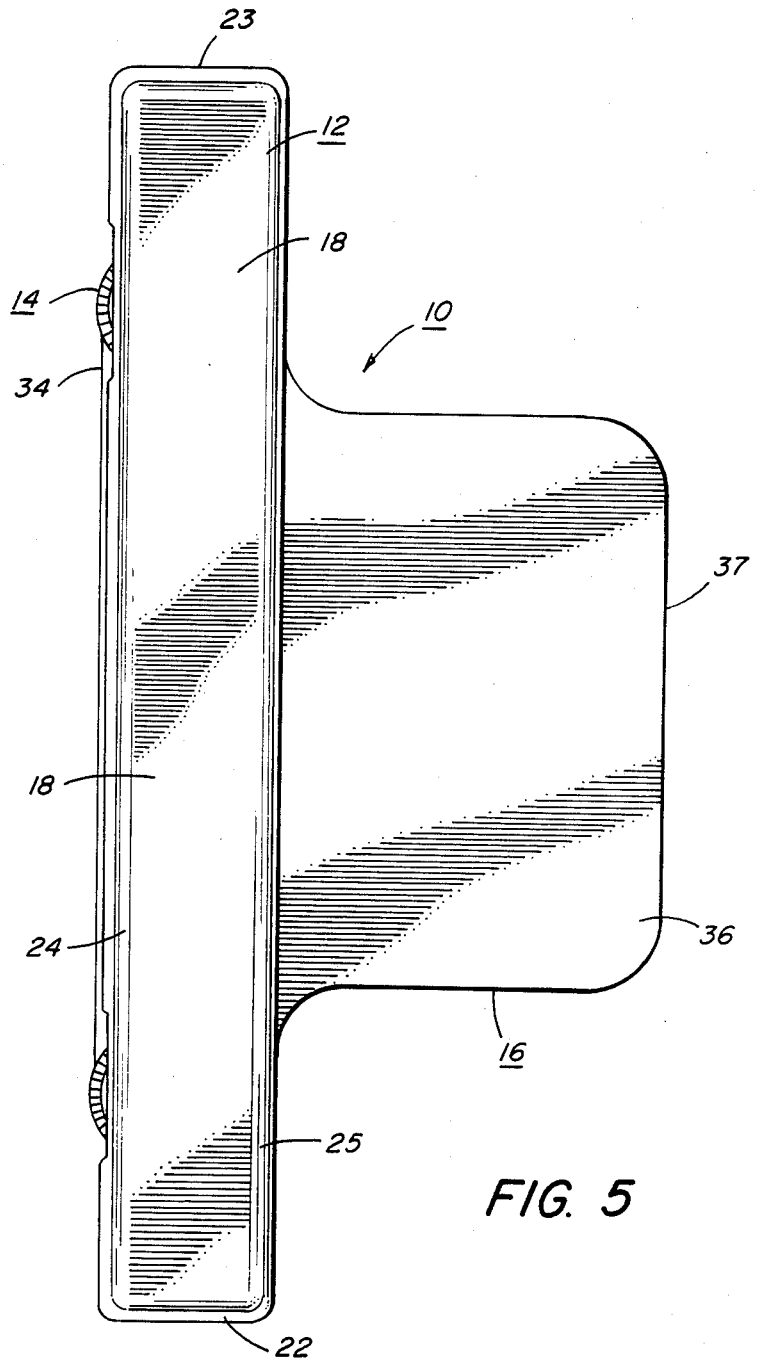
FIG. 5 is a top plain view of FIG. 1.
Figure 4:
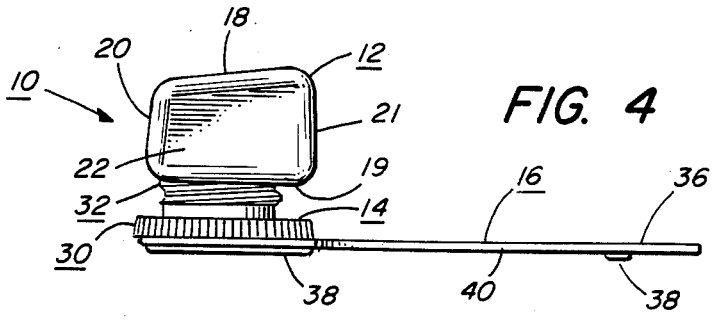
FIG. 4 is a side view in elevation of FIG. 1.

Each of the rotatable means 14 includes a knob 30 and a cylindrical portion 32, as shown in FIGS. 1, 2, and 4. The rotatable means may be of, for example, a molded plastic construction. The knob 30 is designed for manual rotation and can be provided with a knurled outer annular surface 33 for improved friction or traction to facilitate its turning by the operator. Each of the rotatable means 14 are disposed near one of the side surfaces 22 and 23 so as to provide balanced and stable support of the support bar 12. Though two such rotatable means 14, each with a knob 30, are shown and preferred, the invention contemplates the use of a single knob 30 or more than two depending, for example, on the desired length of the top surface 18 (between side surfaces 22 and 23), the choice of materials and strength of construction of the support bar 12 and the rotatable means 14.

The base 16 of the wrist support 10 is, for example, of an eighteen gauge steel sheet construction, designed to rest on a work surface (not shown) in a horizontal, flat orientation, substantially parallel to the top surface 18 of the support bar 12. Each of the rotatable means 14 is fastened to a proximal portion 34 of the base 16. A distal portion 36 of the base 16 extends from the proximal portion 34 toward the rear of the wrist support 10, culminating at rear edge 37. The width of the distal portion 36 should be chosen, for example, so as to permit it to extend under a keyboard (not shown). The length of the distal portion 36 away from said proximal portion 34 should be sufficient to prevent rocking or tilting of the wrist support 10 when in use and may, for example, be 15 to 30 centimeters. In the preferred embodiment utilizing two rotating means 14, the base 16 is of a general "T" shape with the rotating means 14 attached to the proximal portion 34 as described hereinafter. For example, the proximal portion is equal in length and width to the top surface 18 of the support bar 12, to prevent sliding of the base 16 on the work surface (not shown), cork pads 38 may be glued or otherwise affixed to the bottom surface 40 of the base 16.

Figure 6:
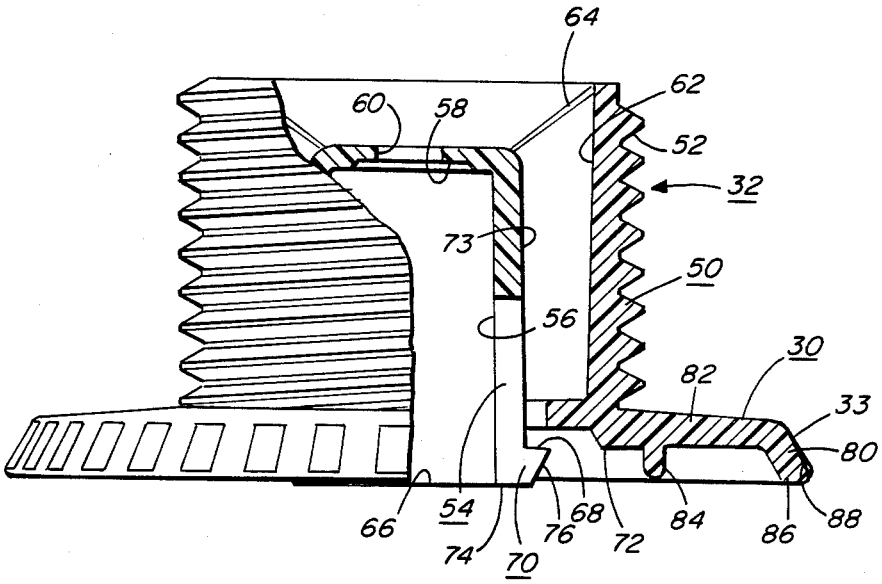
FIG. 6 is a side view, partially broken away of rotatable means for raising and lowering the support bar relative to the base.

FIG. 6 shows further details of each of the rotatable means 14. The cylindrical portion 32 comprises a thin-walled outer cylinder 50 having an external thread 52 and a thin-walled inner cylinder 54, concentrically disposed within the outer cylinder, and having a central bore 56 and a top surface 58 with an opening 60 therethrough in substantial axial alignment with and of a smaller diameter than said bore 56. Between the outer cylinder 50 and the inner cylinder 54 is an annular space 62. A plurality of circumferentially-spaced radially-directed ribs 64 are disposed in said space 62 to physically connect said inner and outer cylinders 50 and 52. The ribs 64 can, for example, be of a substantially planar construction. The inner cylinder 54 is open at its end 66 opposite to top surface 58. The inner cylinder 54 extends axially beyond the outer cylinder 50 at its end 66 sufficient for a surface 68 of a snap feature 70 to substantially align axially with, though spaced from, the bottom end 72 of the outer cylinder 50. Snap feature 70 includes said surface 68 which extends radially outward from external cylindrical surface 73 of the inner cylinder 54 and is substantially parallel to the top surface 58; a bottom surface 74 of the end 66; and inclined surface 76 which extends from the bottom surface 74 to the surface 68 at approximately a 30° to 45° angle. The bottom end 72 of the outer cylinder 50 is connected to the knob 30. The knob 30 extends radially beyond said exterior thread 52 and in a direction parellel to top surface 58 and perpendicular to and away from said inner cylinder 54. The knob 30 is substantially annular and comprises a tip 80 and a substantially planar element 82 connected between the tip and the bottom end 72. The knob 30 may further be provided with an annular strengthening rib 84. The tip 80 extends at, for example, a 45° angle from the planar element 82, in a direction away from said top surface 58. A distal end 86 of the tip 80 is coterminal in the axial direction, though radially-spaced from the strengthening rib 84 and the bottom surface 74. The outer annular surface 33 of the tip 80 can have spaced notches or ridges 88 or be knurled for improved friction or traction for manual turning of the knob 30. The rotatable means 14 can be of one-piece construction or an assembly of separately formed then physically joined pieces such as the knob 30 and the cylindrical portion 32.

Figure 7:
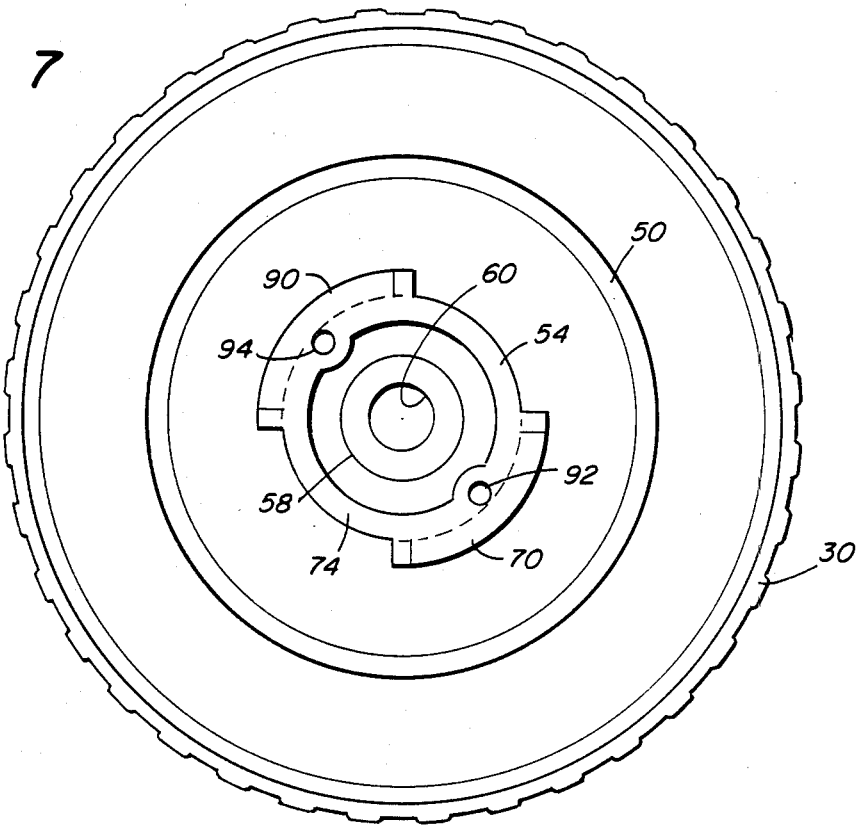
FIG. 7 is a bottom view of the rotatable means.

FIG. 7 shows a bottom view of the rotatable means 14. The outer cylinder 50 with its exterior thread 52 and the inner cylinder 54 with two snap features 70 and 90 are illustrated. In addition, the strengthening rib 84, the bottom surface 74, the top surface 58 and the opening 60 can each be seen. The snap features 70 and 90 are identical. Each extends in arcuate fashion about the bottom surface 74 for approximately one quarter of the circumference, and is disposed diametrically opposite to the other. The snap features 70 and 90 are provided with plier holes 92 and 94 respectively, whose purpose shall be explained below.

Figure 8:
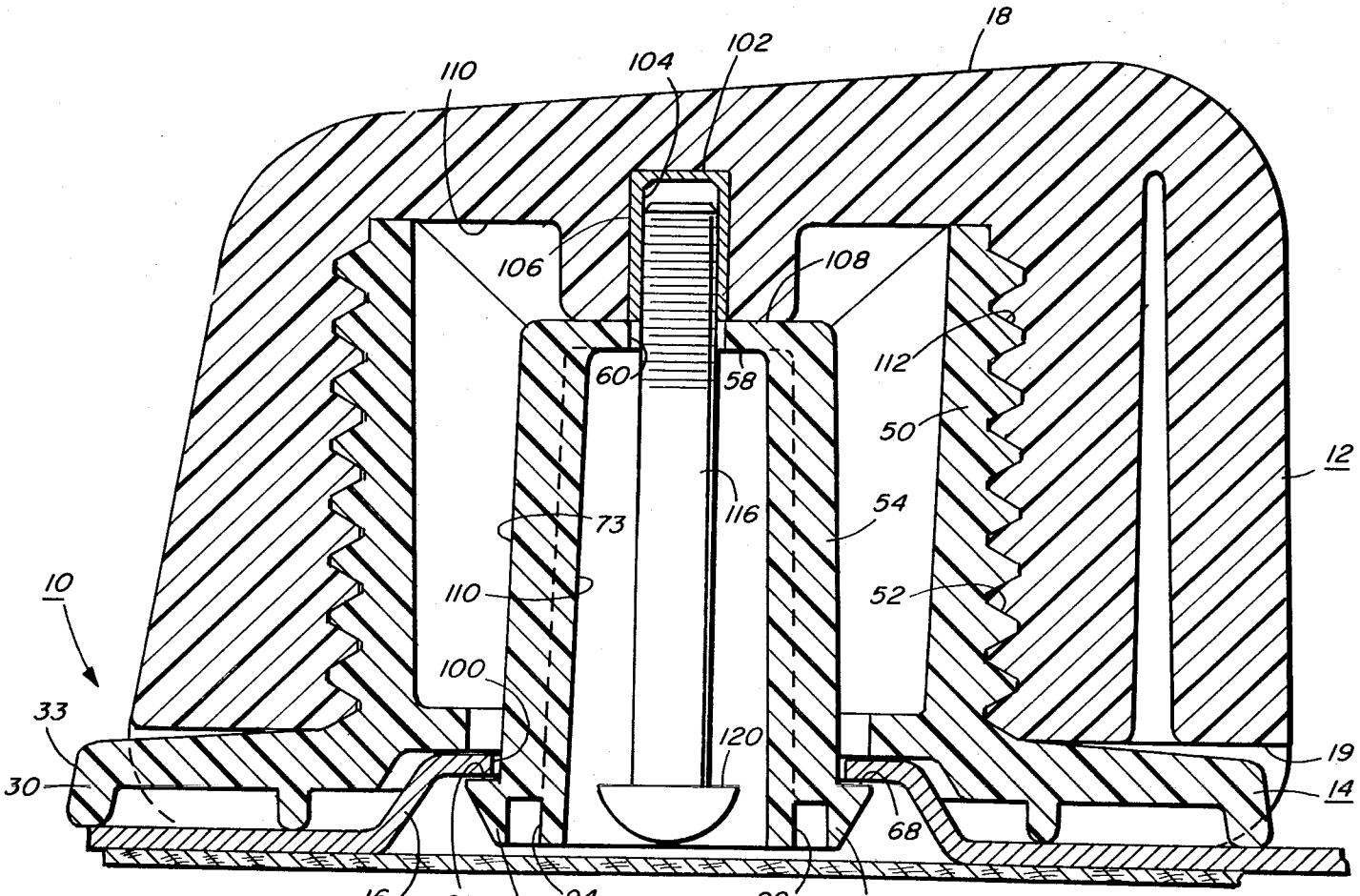
FIG. 8 is a sectional view taken along line VIII—VIII of FIG. 3.

FIG. 8 illustrates the assembly of the wrist support 10. In assembly, the inner cylinder 54 of each of the rotatable means 14 is inserted into an appropriately located hole 100 in the proximal portion 34 of the base 16. The hole 100 is of a diameter slightly larger than that of the exterior surface 73 of the inner cylinder 54 and smaller than that of the surfaces 68 and 69 of the snap features 70 or 90, respectively, at their farthest radial extent. Extending axially for a distance approximately equal to, though less than that of the snap features 70 and 90 in a direction from the bottom surface 74 of the inner cylinder 54 toward the top surface 58 are the pliers holes 92 and 94. These holes permit the insertion of tonged pliers (not shown) which are an aid to assembly. The pliers deform inner cylinder 54 by squeezing the snap features 70 and 90 toward one another for a distance sufficient to provide a clearance fit of the snap features through the hole 100. On release the elastically deformable inner cylinder 54 returns to its previous diameter and is therefore axially locked into, though rotatable within, the hole 100 of the base 16 by the snap features 70 and 90. If desired, and depending on material, geometry and dimensions, any number of snap features can be provided within the scope and spirit of the present invention. Further, other techniques for locking the rotatable means 14 onto or within the base are within the skill of one in the art.

Continuing with the assembly, an expansion insert 102 having an axially-extending threaded bore 104 is securely positioned within a cylindrical relief 106 which is disposed within an inner end wall 108 of bore 110 in the support bar 12. Alternatively said relief is axially threaded. The bore 110 extends axially from the bottom surface 19 of the support bar 12 towards, though not reaching, the top surface 18. The cylindrical wall 112 of bore 110 is threaded to receive in threaded engagement the outer cylinder 50 of the rotatable means 14. The rotatable means 14, after insertion into the base is screwed into the bore 110 via rotation of the knob 30. Shown in this Figure is the wrist support 10 with the support bar 12 in its lowest position, i.e., in its vertical position in which it is closest to the base 16. Vertical adjustment of the support bar 12 relative to the base is easily accomplished by manually rotating the outer annular surface 33 of the knob 30 which, after assembly, extends beyond the front surface 20 of the support bar and is therefore readily accessed. As an example, the wrist support 10 as illustrated is designed so that clockwise motion of the knob 30 as viewed from directly above the wrist support will result in a lowering of a support bar 12, and counterclockwise motion in a raising of the support bar.

To limit the amount of vertical adjustment in order to prevent the accidental disassembly of the support bar 12 from the rotatable means 14, a retaining screw 114 can be provided. Shank portion 116 of the retaining screw 114 is inserted through bore 110 and opening 60 and into threaded engagement with bore 104. The length of the shank portion 116 between top surface 58 and head portion 120 of the retaining screw 114, after assembly as shown in this figure, should be less than the axial extent of the external thread 52 of the outer cylinder 50. The diameter of the head portion should be larger than that of opening 60. Thus the head portion 120 contacts top surface 58 when the support bar 12 is in its highest vertical position, and thereafter prevents further rotation of the knob 30 in the direction that would otherwise raise the support bar 12 relative to the base 16. This prevents accidental disassembly of the wrist support 10.

It should now be understood that the relief 106, insert bore 104, inner cylinder 54, outer cylinder 50 and opening 60 are all arranged coaxially.

In the practice of the invention as illustrated, two substantially-identical assemblies as shown in FIG. 8 are utilized since two rotatable means 14 are incorporated in the wrist support 10.

Figure 9:
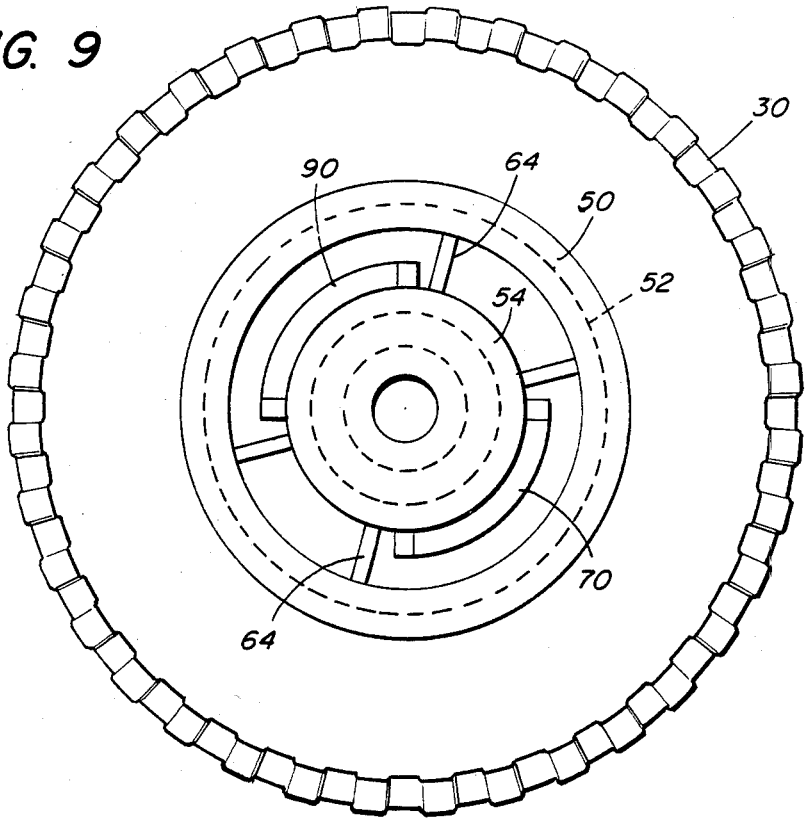
FIG. 9 is a top view of the rotatable means.

FIG. 9 is a top view of the rotatable means 14. The ribs 64 of planar construction are shown as extending from the inner cylinder 54 to the outer cylinder.

Additionally, in the preferred embodiment the wrist support 10 is not attached to either the office machine or the work surface. It is designed to provide the necessary stability and support without such attachment. In fact, the operator, for example, of a computer terminal keyboard (not shown) may desire to place the wrist support 10 closer to or farther from the keyboard to suit his or her personal comfort. Since the wrist support 10 merely rests on the work surface this can be easily accomplished. Of course, if attachment to the keyboard is desired, the base can be readily modified in design by one skilled in the art to practice the invention accordingly. For example, the base could be integrally manufactured with the keyboard housing (not shown) or be bolted to the underside thereof or to the work surface. All such means are within the spirit and scope of the invention.

What is claimed:

1. A wrist support for use with a keyboard, comprising a base, an elongate support bar having a top and bottom surface, first and second spaced apart rotatable means, means for securing said first and second rotatable means to said base for preventing axial movement therebetween while permitting rotational movement relative thereto, said first and second rotatable means each including a cylindrical portion having an exterior threaded surface, and a knob operable separately from said securing means, disposed adjacent to said base and fixedly connected at a first end of said cylindrical portion, said bottom surface of said support bar having therethrough an internally threaded bore which extends axially from said bottom surface toward though not to said top surface, said bore being sized to receive a second end of said cylindrical portion in threaded engagement therewith, wherein manual rotation of said knob turns said cylindrical portions therewith relative to the support bar causing the support bar to screw or unscrew on the cylindrical portions, and thereby adjusts the height of the support bar relative to the base without disassembly therefrom.

2. The wrist support of claim 1 wherein said base comprises a proximal portion to which is secured said rotatable means and a distal portion connected to and substantially coplanar with said proximal portion and extending therefrom and beyond said support bar, said base being adapted and configured to support said support bar and said distal portion to slide beneath the keyboard.

3. The wrist support of claim 1 further comprising means for preventing accidental disassembly of the support bar from the rotatable means.

4. The wrist support of claim 1 wherein the bore in said support bar is defined by a threaded cylindrical surface and a surface perpendicularly connected to said cylindrical surface at the axial extent thereof closest to the top surface of the support bar and in spaced-parallel relation thereto, and said support bar further includes a relief defined within said perpendicular surface, said relief having a threaded bore for receiving a threaded shank of a bolt.

5. The wrist support of claim 4 wherein each rotatable means includes an inner and an outer cylindrical portion, said outer cylindrical portion having a threaded outer cylindrical surface, said inner cylinder being concentric to and within said outer cylinder, said inner cylinder having a bore therethrough and a top surface substantially parallel to the top surface of said support bar, said top surface of said inner cylinder having a hole therethrough sized to receive the shank of the bolt with a clearance fit, but smaller in diameter than said head of said bolt, whereby when said knob is rotated in a direction which vertically raises said support bar relative to said base, said vertical movement is limited beyond a predetermined point by the action of the head of the bolt against the hole in the top surface of the inner cylinder.

6. The wrist support of claim 1 wherein the securing means includes an elastically deformable snap feature, said base has a hole; and said snap feature, when deformed, extends through said hole with a clearance fit and when no longer deformed, returns to its nondeformed configuration which prevents the removal of the snap feature from the hole.

* * * * *